US011235293B2

(12) United States Patent
Anderson et al.

(10) Patent No.: US 11,235,293 B2
(45) Date of Patent: Feb. 1, 2022

(54) MATERIAL WETTING SYSTEM WITH SHROUD ASSEMBLY

(71) Applicant: Ecolab USA Inc., St. Paul, MN (US)

(72) Inventors: Daniel Davis Anderson, Eagan, MN (US); Brock Stephen Mueggenborg, St. Paul, MN (US); Karl Heinbuch, Roberts, WI (US); David W. Scheimann, Joliet, IL (US); Alex Bodga, Ballston Spa, NY (US); Thomas E. Peacock, Elburn, IL (US)

(73) Assignee: Ecolab USA Inc., St. Paul, MN (US)

( * ) Notice: Subject to any disclaimer, the term of this patent is extended or adjusted under 35 U.S.C. 154(b) by 488 days.

(21) Appl. No.: 16/207,752

(22) Filed: Dec. 3, 2018

(65) Prior Publication Data

US 2019/0168176 A1 Jun. 6, 2019

Related U.S. Application Data

(60) Provisional application No. 62/594,309, filed on Dec. 4, 2017.

(51) Int. Cl.
*B01F 5/04* (2006.01)
*B01F 15/02* (2006.01)
(Continued)

(52) U.S. Cl.
CPC ..... *B01F 5/043* (2013.01); *B01F 3/12* (2013.01); *B01F 3/1228* (2013.01);
(Continued)

(58) Field of Classification Search
CPC ..... B01F 15/00961; B01F 15/00974; B01F 15/0235; B01F 15/0243; B01F 2215/0049;
(Continued)

(56) References Cited

U.S. PATENT DOCUMENTS 2,029,219 A 1/1936 Bourland
2,105,589 A 1/1938 Eades
(Continued)

FOREIGN PATENT DOCUMENTS

AR 242752 A1 5/1993
AU 2003237240 B9 2/2004
(Continued)

OTHER PUBLICATIONS

U.S. Appl. No. 16/207,844, filed Dec. 3, 2018.
(Continued)

*Primary Examiner* — Tony G Soohoo
(74) *Attorney, Agent, or Firm* — Leydig, Voit & Mayer, Ltd.

(57) ABSTRACT

A material wetting system for wetting a powder material includes a liquid supply system, a material mixing unit, a material supply system, and a shroud assembly. The liquid supply system includes a supply line. The material mixing unit is in fluid communication with the supply line and includes a central cavity having an open upper end configured to receive a supply of powder material. The material mixing unit is configured to receive liquid from the supply line and is operatively connected to a reduced pressure source to draw air into the central cavity. The material supply system includes an orifice and is configured to feed powder material through the orifice, with the orifice disposed above the central cavity of the material mixing unit. The shroud assembly is disposed about the open upper end of the central cavity of the material mixing unit and the orifice of the material supply system.

20 Claims, 13 Drawing Sheets

(51) Int. Cl.

| | |
|---|---|
| ***B01F 15/00*** | (2006.01) |
| ***B01F 5/00*** | (2006.01) |
| ***B01F 5/24*** | (2006.01) |
| ***B01F 3/12*** | (2006.01) |

(52) U.S. Cl.
CPC ..... *B01F 3/1271* (2013.01); *B01F 5/0065* (2013.01); *B01F 5/0498* (2013.01); *B01F 5/248* (2013.01); *B01F 15/00961* (2013.01); *B01F 15/00974* (2013.01); *B01F 15/0235* (2013.01); *B01F 15/0243* (2013.01); *B01F 2215/0049* (2013.01)

(58) Field of Classification Search
CPC ..... B01F 3/12; B01F 3/1228; B01F 3/1271; B01F 5/0065; B01F 5/043; B01F 5/0498; B01F 5/248
See application file for complete search history.

(56) References Cited

U.S. PATENT DOCUMENTS 3,207,485 A * 9/1965 Warren ..... B01F 3/1228 366/101
3,225,963 A 12/1965 Arpajian
3,239,111 A 3/1966 La Croce
3,308,995 A 3/1967 Lee et al.
3,327,905 A 6/1967 Gould
3,610,088 A * 10/1971 Clay ..... B01F 13/0035 86/20.15
3,773,221 A 11/1973 Lesk et al.
3,870,283 A * 3/1975 Hurst ..... B01F 5/0074 366/143
4,007,921 A 2/1977 Zingg
4,021,021 A 5/1977 Hall et al.
4,095,723 A 6/1978 Lerner
4,153,403 A * 5/1979 Schneider ..... A47J 31/401 425/159
4,212,415 A 6/1980 Neely
4,239,396 A * 12/1980 Arribau ..... B01F 5/225 366/170.3
4,274,563 A 6/1981 Otterson
4,349,157 A 9/1982 Beiswenger et al.
4,366,920 A 1/1983 Greenfield, Jr. et al.
4,376,497 A 3/1983 Mumford
4,429,815 A 2/1984 Libit
4,534,654 A * 8/1985 Alt ..... B01F 5/10 366/137
4,548,331 A 10/1985 Montgomery
4,586,459 A 5/1986 Schultz
4,613,063 A 9/1986 Wright
4,614,435 A * 9/1986 McIntire ..... B01F 7/1625 366/40
4,828,130 A 5/1989 Hofmann
RE33,083 E 10/1989 Pellegrino
4,892,233 A 1/1990 Zelickson
5,046,855 A * 9/1991 Allen ..... B01F 13/10 366/137
5,172,740 A 12/1992 Simmel et al.
5,261,432 A 11/1993 Sandrin
5,322,085 A 6/1994 Prothe
5,322,357 A * 6/1994 Mazer ..... B01F 5/16 366/181.1
5,344,619 A 9/1994 Larwick et al.
5,407,107 A 4/1995 Smith
5,495,962 A 3/1996 Nomura
5,513,776 A 5/1996 Canini
5,538,341 A * 7/1996 Padgett ..... B01F 5/0268 366/134
5,582,162 A 12/1996 Petersson
5,601,213 A 2/1997 Daniello
5,609,458 A 3/1997 Hanaoka et al.
5,687,782 A 11/1997 Cleveland et al.
5,813,754 A * 9/1998 Williams ..... B01F 11/0068 366/114
5,904,419 A * 5/1999 Arribau ..... B01F 3/1221 366/167.2
5,967,383 A 10/1999 Hidalgo
6,045,255 A * 4/2000 Ogier ..... B01F 3/1228 366/165.2
6,050,309 A 4/2000 Woodruff
6,085,809 A 7/2000 Woodruff
6,179,164 B1 1/2001 Fuchs
6,193,116 B1 2/2001 Sheffler et al.
6,257,172 B1 7/2001 Leppanen
6,283,339 B1 9/2001 Morrow
6,305,443 B1 10/2001 Semenenko
6,311,745 B1 11/2001 Welch et al.
D479,801 S 9/2003 Carmichael et al.
6,886,719 B1 5/2005 Shen et al.
6,988,642 B2 1/2006 Gallo, Jr. et al.
7,073,546 B2 7/2006 Woodruff
7,438,204 B2 10/2008 Conway et al.
7,618,182 B1 * 11/2009 Lott ..... B01F 3/1228 366/163.1
7,784,999 B1 * 8/2010 Lott ..... B01F 5/0413 366/163.2
7,980,277 B2 7/2011 Amano
D677,987 S 3/2013 High
8,833,614 B2 9/2014 Webster et al.
9,139,963 B2 9/2015 Zwahlen et al.
10,137,420 B2 * 11/2018 Luharuka ..... B01F 5/248
10,562,062 B2 * 2/2020 Dobizl ..... F16K 1/205
10,589,238 B2 * 3/2020 Chong ..... B28C 7/0454
10,753,483 B2 * 8/2020 Feiler ..... B65G 69/183
10,961,002 B2 * 3/2021 Mueggenborg ..... B65B 37/02
2002/0125275 A1 9/2002 Smith
2002/0145010 A1 10/2002 Ufheil et al.
2002/0145013 A1 10/2002 Chrisman et al.
2003/0159751 A1 8/2003 Chamba
2004/0079765 A1 4/2004 Gallo, Jr. et al.
2005/0103337 A1 5/2005 Hickey et al.
2005/0247742 A1 11/2005 Livingston et al.
2005/0263373 A1 12/2005 Boevers
2006/0027609 A1 2/2006 Landau et al.
2006/0070999 A1 4/2006 Stull et al.
2006/0164914 A1 * 7/2006 Goto ..... B01F 5/0619 366/165.2
2006/0191958 A1 8/2006 Brundick
2006/0278665 A1 12/2006 Bennett
2007/0034642 A1 2/2007 Pendleton
2007/0084885 A1 4/2007 Conway et al.
2007/0181600 A1 8/2007 Ben-Shlomo et al.
2008/0054014 A1 3/2008 Webster et al.
2008/0072993 A1 3/2008 Luchinger et al.
2008/0093394 A1 4/2008 Peterson et al.
2009/0127289 A1 5/2009 Keller
2009/0145510 A1 6/2009 Luechinger
2009/0188517 A1 7/2009 Thorpe et al.
2009/0188518 A1 7/2009 Thorpe et al.
2009/0258547 A1 10/2009 Pardikes
2009/0309006 A1 12/2009 Johnsgaard
2010/0012120 A1 1/2010 Herder et al.
2010/0204441 A1 8/2010 Pardikes
2011/0099950 A1 5/2011 Dunn et al.
2011/0101023 A1 5/2011 Chan et al.
2012/0080457 A1 4/2012 Lovinger et al.
2012/0267401 A1 10/2012 Schroedter
2013/0167972 A1 7/2013 Peressoni
2014/0103153 A1 4/2014 Below
2014/0166439 A1 6/2014 Hughes
2014/0230963 A1 8/2014 Simon et al.
2015/0021364 A1 1/2015 Zehnder et al.
2015/0238912 A1 * 8/2015 Luharuka ..... B01F 3/1221 366/182.2
2015/0238913 A1 * 8/2015 Luharuka ..... B01F 7/00641 366/138
2017/0333928 A1 11/2017 Chapron et al.

FOREIGN PATENT DOCUMENTS

AU 2005204344 A1 4/2006
CA 1082475 A 7/1980

(56) References Cited

FOREIGN PATENT DOCUMENTS

| | | | |
|---|---|---|---|
| CA | 1113734 | A | 12/1981 |
| CA | 1254172 | A | 5/1989 |
| CA | 1306979 | C | 9/1992 |
| CA | 2152088 | A1 | 7/1994 |
| CA | 2012098 | C | 11/1994 |
| CA | 2237351 | A1 | 11/1998 |
| CA | 2152088 | C | 12/1999 |
| CN | 200981706 | Y | 11/2007 |
| CN | 200985145 | Y | 12/2007 |
| CN | 201686132 | U | 12/2010 |
| CN | 202193332 | U | 4/2012 |
| CN | 102923390 | A | 2/2013 |
| CN | 204471651 | U | 7/2015 |
| EP | 0115321 | A2 | 8/1984 |
| EP | 319349 | A1 | 6/1989 |
| EP | 708734 | A1 | 5/1996 |
| EP | 0664667 | B1 | 3/1998 |
| EP | 0923993 | A1 | 6/1999 |
| EP | 1500911 | A1 | 1/2005 |
| EP | 1902956 | A1 | 3/2008 |
| EP | 2447186 | B1 | 5/2012 |
| EP | 2632302 | B2 | 7/2014 |
| GB | 2295609 | A | 6/1996 |
| GB | 2296711 | A | 7/1996 |
| GB | 2328926 | A | 3/1999 |
| GB | 2457110 | A | 8/2009 |
| GB | 2457111 | A | 8/2009 |
| GB | 2489721 | A | 10/2012 |
| JP | H03-216697 | A | 9/1991 |
| JP | 4206175 | B2 | 1/2009 |
| NZ | 20060544807 | | 11/2007 |
| WO | WO 85/00156 | A1 | 1/1985 |
| WO | WO 88/07324 | A1 | 10/1988 |
| WO | WO 88/08269 | A1 | 11/1988 |
| WO | WO 95/03240 | A1 | 2/1995 |
| WO | WO 95/15893 | A1 | 6/1995 |
| WO | WO 96/04410 | A1 | 2/1996 |
| WO | WO 97/30743 | A1 | 8/1997 |
| WO | WO 99/44663 | A1 | 9/1999 |
| WO | WO 03/093773 | A1 | 11/2003 |
| WO | WO 2004/041435 | A2 | 5/2004 |
| WO | WO 2006/119324 | A2 | 11/2006 |
| WO | WO 2007/120133 | A2 | 10/2007 |
| WO | WO 2007/141601 | A1 | 12/2007 |
| WO | WO 2009/050710 | A2 | 4/2009 |
| WO | WO 2010/150087 | A1 | 12/2010 |
| WO | WO 2013/010702 | A1 | 1/2013 |
| WO | WO 2014/031474 | A2 | 2/2014 |
| WO | WO 2015/158724 | A1 | 10/2015 |
| WO | WO 2016/016649 | A1 | 2/2016 |
| WO | WO 2016/019299 | A1 | 2/2016 |
| WO | WO 2018/093992 | A1 | 5/2018 |
| WO | WO 2018/093995 | A1 | 5/2018 |

OTHER PUBLICATIONS

U.S. Appl. No. 15/814,726, filed Nov. 16, 2017.

U.S. Appl. No. 15/814,680, filed Nov. 16, 2017.

European Patent Office, International Search Report in International Patent Application No. PCT/US2017/061934, 7 pp, (dated Apr. 30, 2018).

European Patent Office, Written Opinion in International Patent Application No. PCT/US2017/061934, 13 pp, (dated Apr. 30, 2018).

European Patent Office, International Search Report in International Patent Application No. PCT/US2018/063603, 6 pp, (dated Mar. 29, 2019).

European Patent Office, Written Opinion in International Patent Application No. PCT/US2018/063603, 7 pp, (dated Mar. 29, 2019).

* cited by examiner

MATERIAL WETTING SYSTEM WITH SHROUD ASSEMBLY

This application is a nonprovisional application claiming the benefit of U.S. Provisional Patent Application Ser. No. 62/594,309, filed Dec. 4, 2017, the disclosure of which is incorporated herein by reference in its entirety.

TECHNICAL FIELD

The present disclosure relates generally to material wetting systems and, more particularly, to a material wetting system for the makedown of powder material utilizing a shroud assembly adjacent a mixing unit to limit air currents.

BACKGROUND

Systems for the makedown of powder material such as dry polymers may include a plurality of units or stations. These stations may include a material storage station, a material supply station in which material is supplied from the storage station, and a mixing station at which the dry polymer is mixed with a liquid such as water. In some instances, a holding station including one or more holding tanks may be provided at which the wetted solution may be held until use.

In some instances, as a result of manufacturing processes, some of the powder material used with the makedown process may be extremely fine (e.g., smaller than 200 μm). Extremely fine powder material may be difficult to handle as it may approximate or act like dust during some processes. Accordingly, it is sometimes desirable to filter out the extremely fine powder material as part of the material manufacturing or preparation process prior to the makedown process. However, in some instances, as much as 7% of the material may be filtered when removing the extremely fine powder. This filtered material may not be useable in any other process and may end up as waste product.

SUMMARY

An improved material wetting system for wetting a powder material is provided. The material wetting system comprises a liquid supply system, a material mixing unit, a material supply system, and a shroud assembly. The liquid supply system includes a supply line configured to provide a liquid. The material mixing unit is in fluid communication with the supply line and includes a central cavity having an open upper end configured to receive a supply of powder material. The material mixing unit is configured to receive the liquid from the supply line and is operatively connected to a reduced pressure source to draw air into the central cavity. The material supply system includes an orifice and is configured to feed powder material through the orifice, with the orifice disposed above the central cavity of the material mixing unit. The shroud assembly is disposed about the open upper end of the central cavity of the material mixing unit and the orifice of the material supply system.

In another aspect, an improved material wetting system for wetting a powder material comprises a liquid supply system, an eductor, a material supply system, and a shroud assembly. The liquid supply system includes a supply line configured to provide a liquid. The eductor is in fluid communication with the supply line and includes a central cavity having a central axis and an open upper end configured to receive a supply of powder material. The eductor is configured to receive the liquid from the supply line and is operatively connected to a reduced pressure source to draw air into the central cavity. The material supply system includes an orifice and is configured to feed powder material through the orifice, with the orifice disposed along the central axis and above the central cavity of the eductor. The shroud assembly is disposed about the open upper end of the central cavity of the eductor and the orifice of the material supply system.

DETAILED DESCRIPTION

Figure 1:
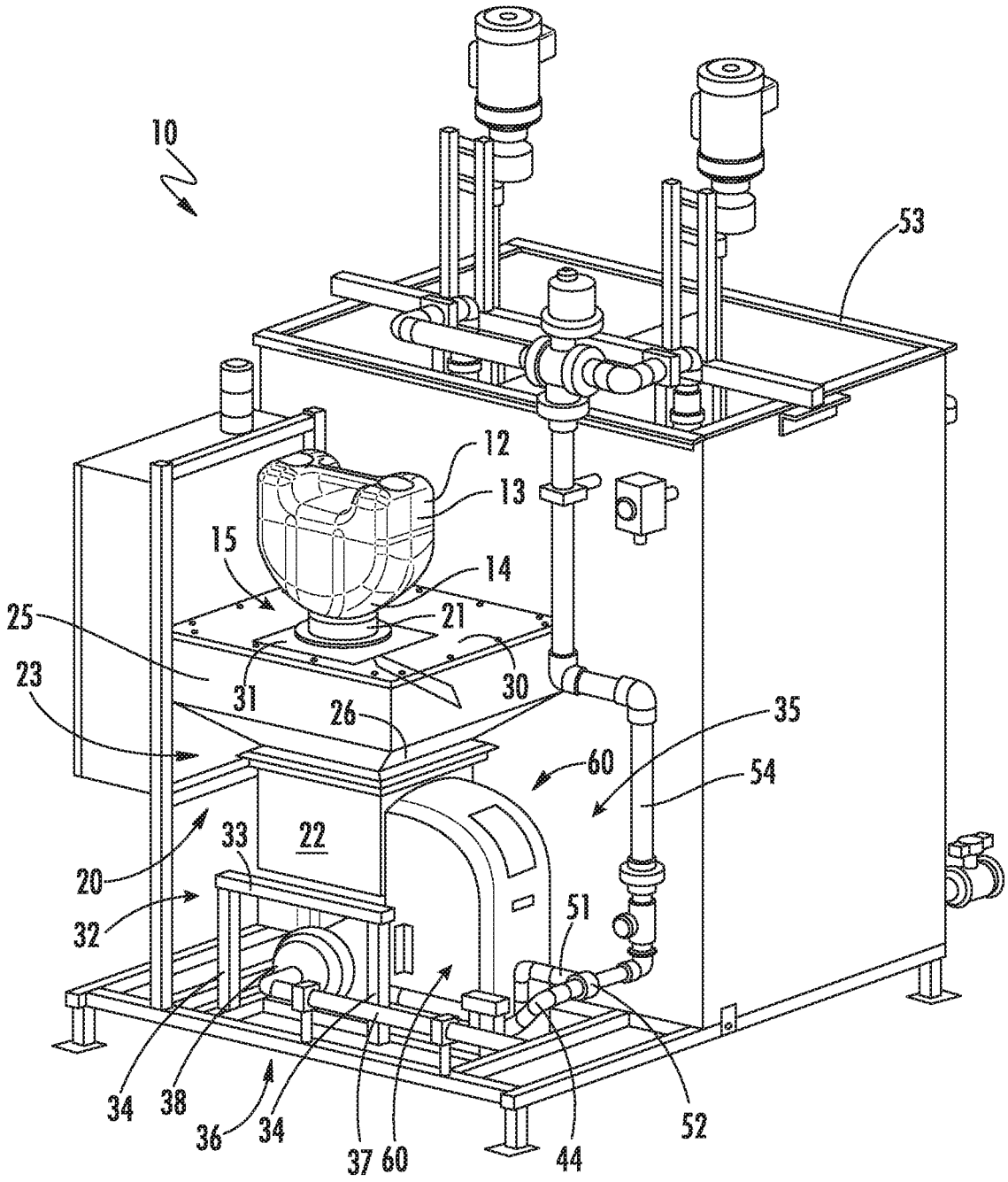
FIG. 1 is a perspective view of a system for processing a dry powder material and forming a homogeneous aqueous liquid substance.

Referring to FIG. 1, a system 10 for processing a powder material, such as a dry polymer, to form a homogeneous aqueous liquid substance is depicted. The system 10 comprises a container 12, a material feed system 20, a material wetting system 35, a shroud assembly 60 surrounding the material wetting system, and a tank 53.

The container 12 is configured to contain and deliver a solid flowable powder material such as a dry polymer. The container 12 may have any desired configuration and, as depicted, includes a closed body section 13 and a tapered section 14 with an opening (not shown) at the bottom through which the material within the container may be discharged.

A fitment or valve assembly, indicated generally at 15, may be secured to the lower end of the tapered section 14 of the container 12 to control the flow of material from the container. The valve assembly 15 may interact with a docking station or base 21 mounted on the material feed system 20 as desired to open and close the valve assembly.

Figure 2:
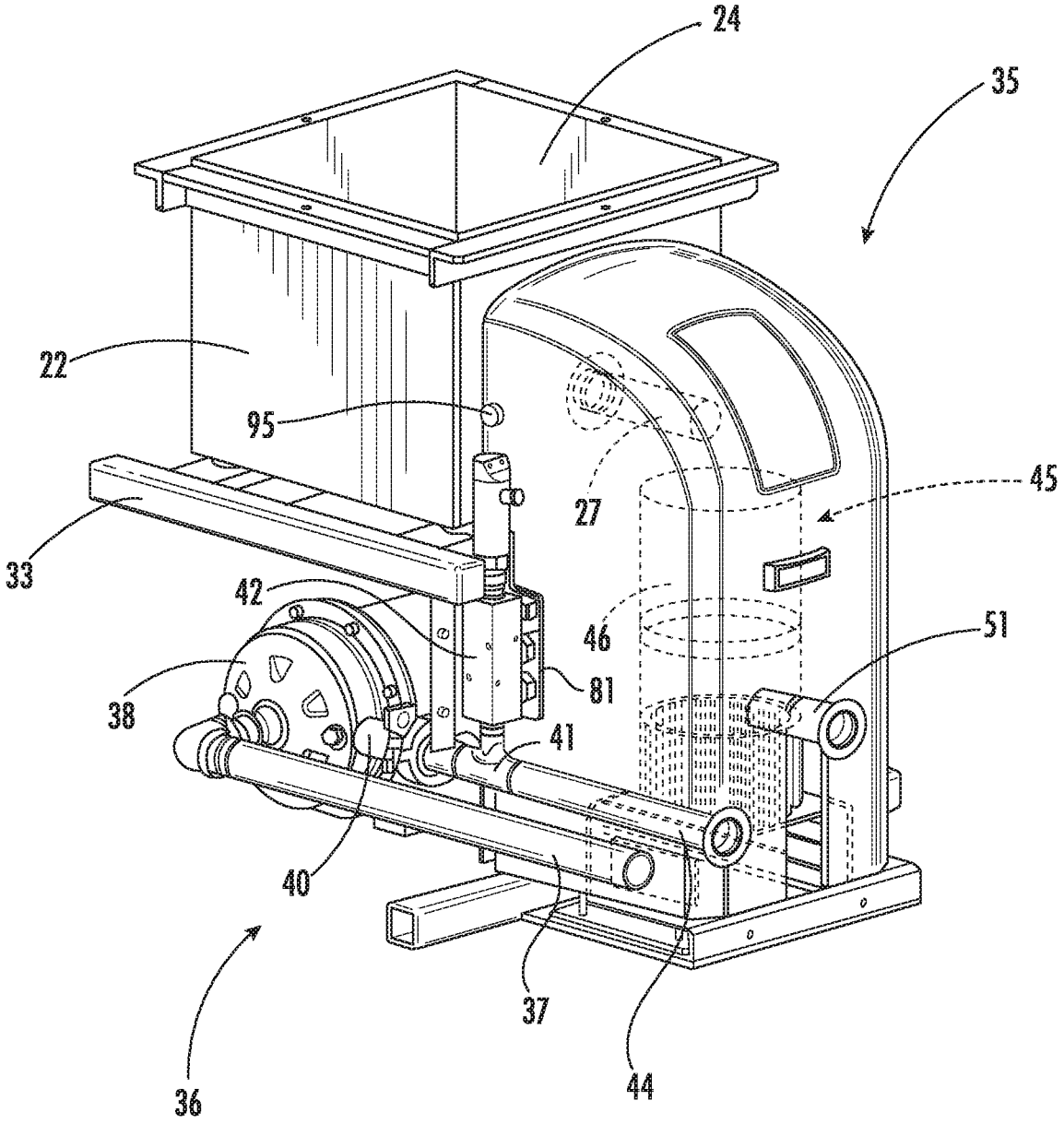
FIG. 2 is a perspective view of a portion of the system of FIG. 1 including a container, a material feed system, a mixing system, and shroud assembly.
Figure 3:
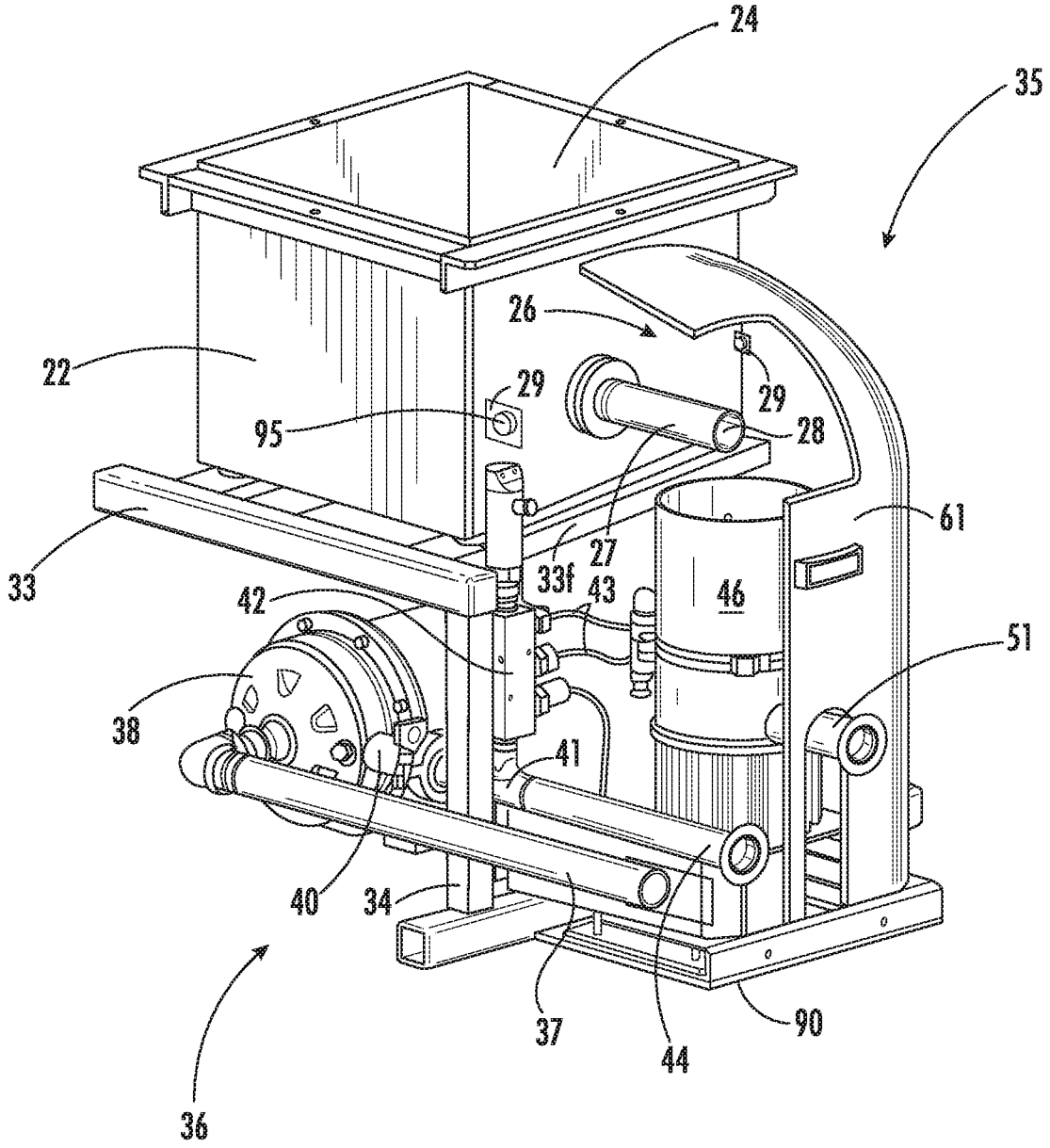
FIG. 3 is a perspective view similar to FIG. 2 but with a portion of the shroud assembly in section.
Figure 4:
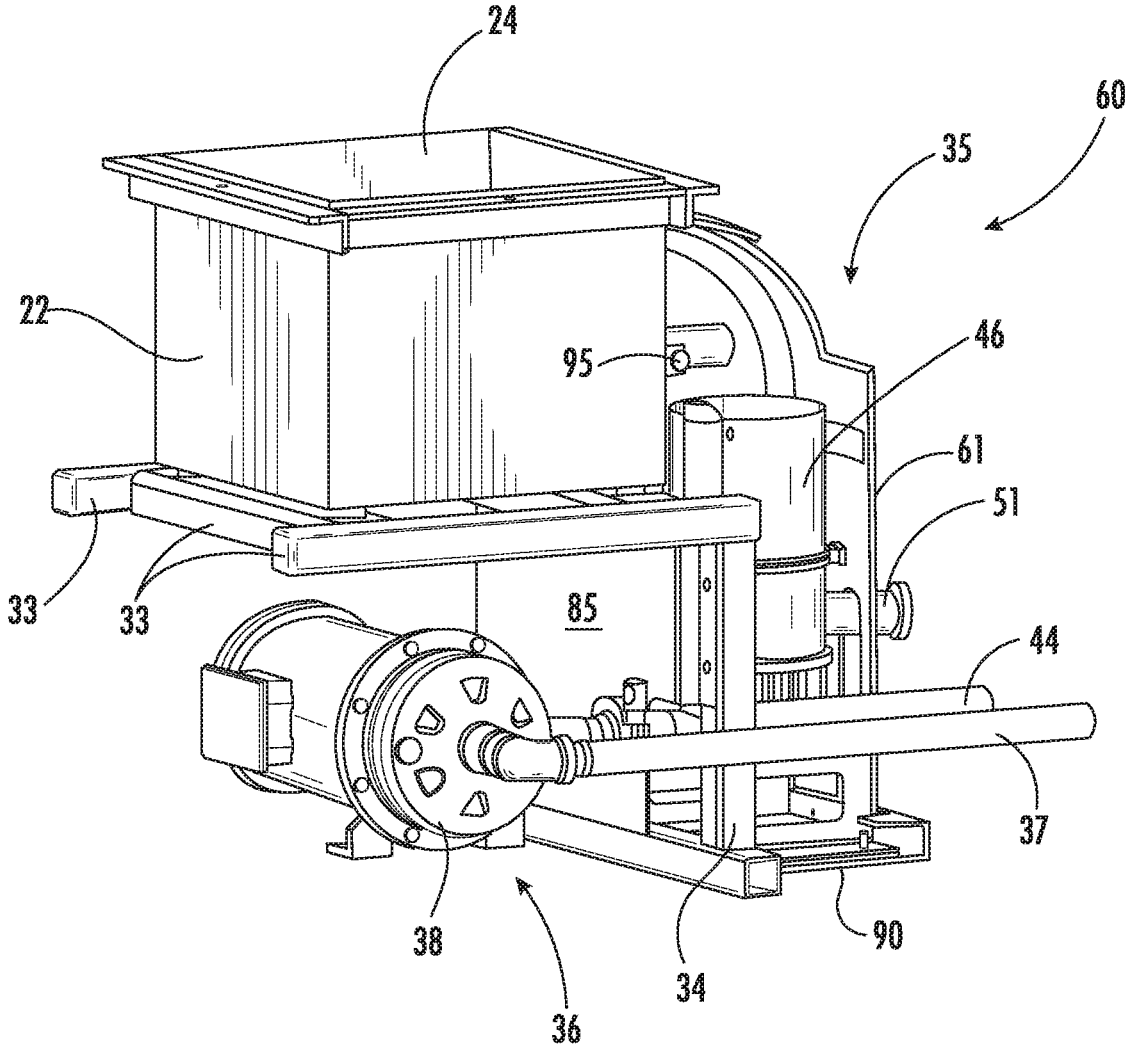
FIG. 4 is a perspective view similar to FIG. 3 but from a second perspective.
Figure 5:
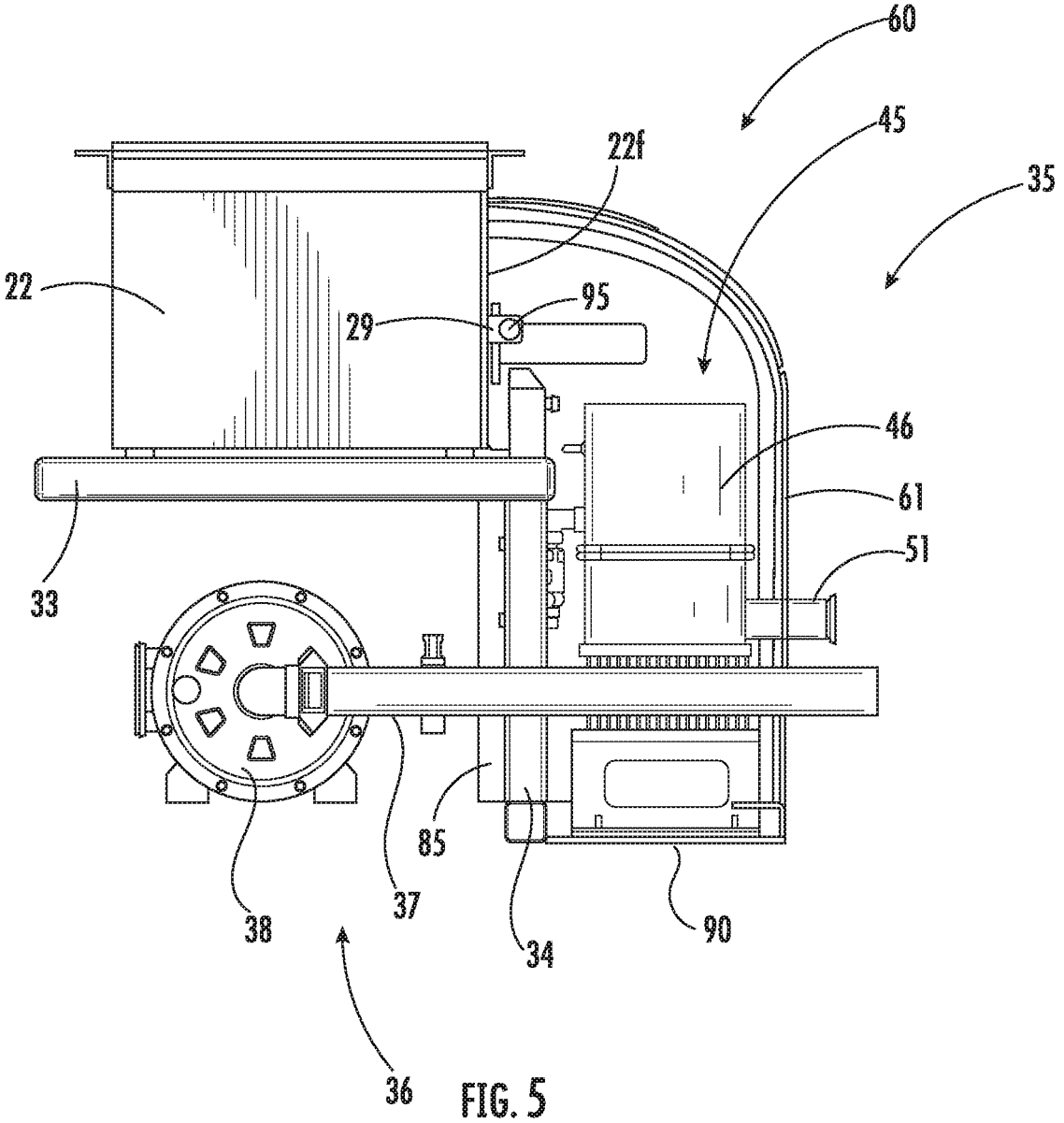
FIG. 5 is a side view of the portion of the system of FIG. 3.
Figure 6:
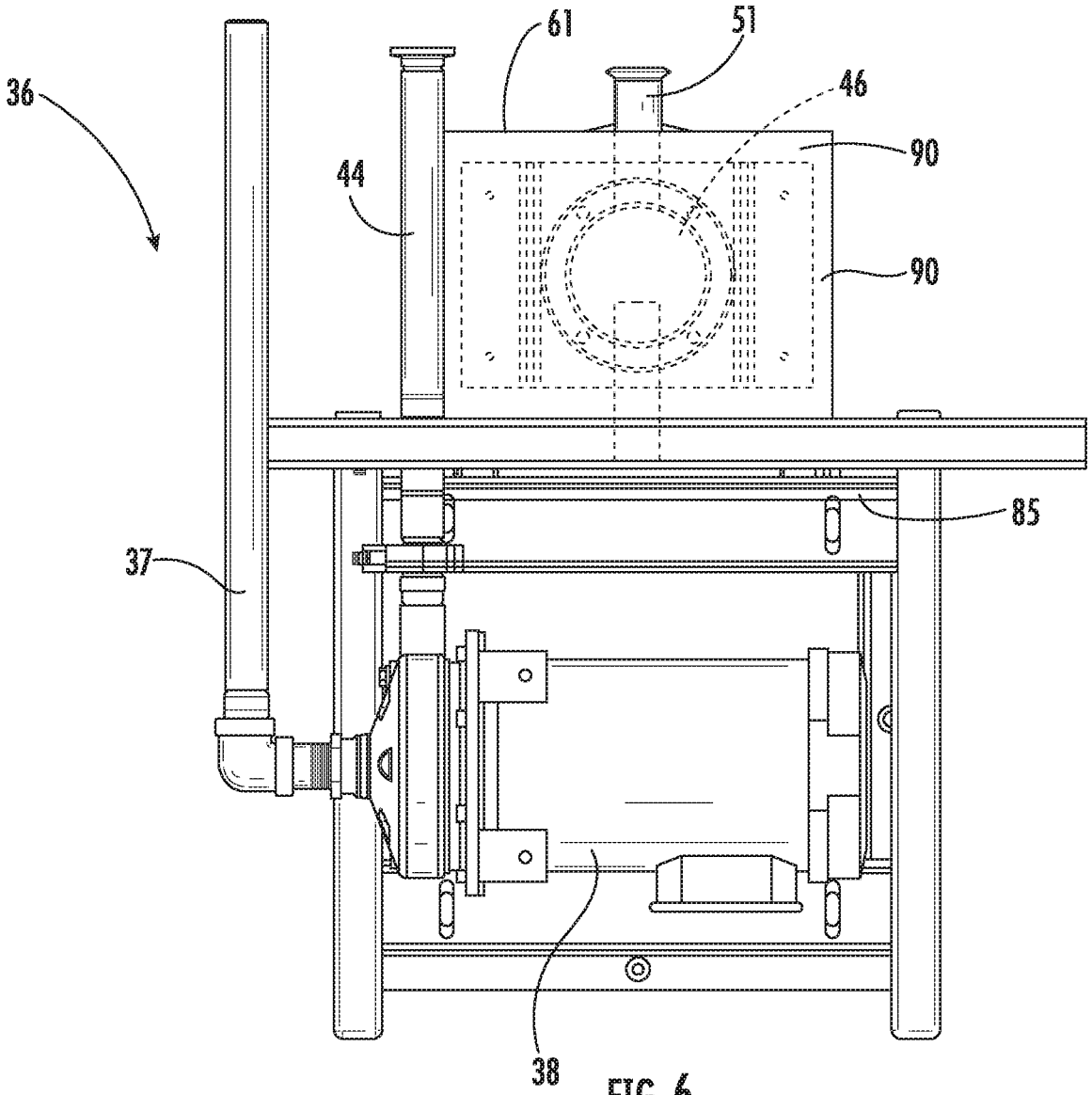
FIG. 6 is a bottom view of the portion of the system of FIG. 2.

The material feed system 20 includes a housing 22 that supports a hopper 23. As depicted, the hopper 23 is formed of a lower portion or lower hopper 24 and an upper portion or hopper extension 25 (FIG. 2), The hopper extension 25 includes sloped sidewalls 26 configured to direct material from the container 12 into the lower portion 24 of the hopper 23. The lower portion 24 of the hopper 23 includes sloped sidewalls (not shown) configured to direct material from the hopper 23 to a feed assembly generally indicated at 26 such as an auger within a material feed tube 27. The feed tube 27 may extend outward from or through the front wall 22*f* of housing 22 and includes an end or orifice 28.

The hopper extension 25 may be sealed with a cover 30 such as a transparent sheet of acrylic material. The cover 30 includes a hole (not shown) aligned with the docking station or base 21. In some embodiments, a mesh 31 may be disposed on the cover 30 adjacent and aligned with the hole and is configured with openings large enough to permit powder material to flow unimpeded from the container 12 but small enough to prevent foreign objects from falling into the hopper 23 if a container is not positioned on the base 21.

The housing 22 is supported at an elevated position by a frame assembly 32. The frame assembly 32 includes a plurality of horizontal members 33 on which the housing 22 is disposed and a plurality of vertical members or legs 34 that support the horizontal members at the desired height or elevation.

Referring to FIGS. 2-6, the material wetting system 35 includes a liquid supply system, generally indicated at 36, for supplying liquid such as water to a wetting unit 45 (FIGS. 2-5) at which the powder material is mixed with the liquid. The liquid supply system 36 includes a supply line or pipe 37 that feeds a liquid such as water to a booster pump 38. As depicted, the booster pump 38 is located below the housing 22 of the material feed system 20. The liquid is discharged from the booster pump 38 into an outlet pipe 40 which feeds into a T-connection 41 that operates to split the flow of liquid from the booster pump. A first portion of the liquid travels upward into a manifold 42 and then through feed lines 43 to be subsequently used to mix the powder material. A second portion of the liquid travels through an additional supply line or pipe 44.

Figure 7:
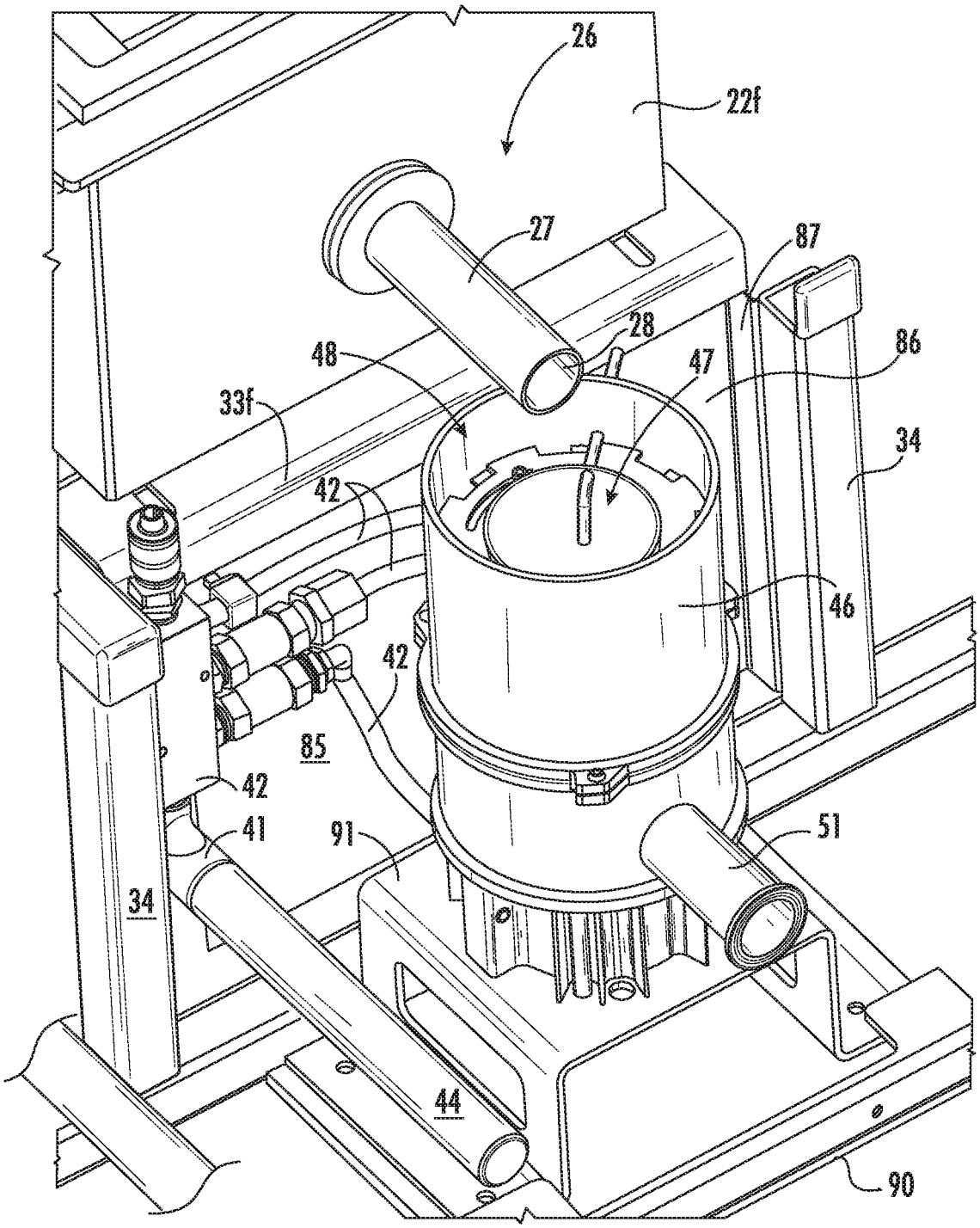
FIG. 7 is an enlarged perspective view of a feed tube and a wetting unit of the system of FIG. 2.
Figure 8:
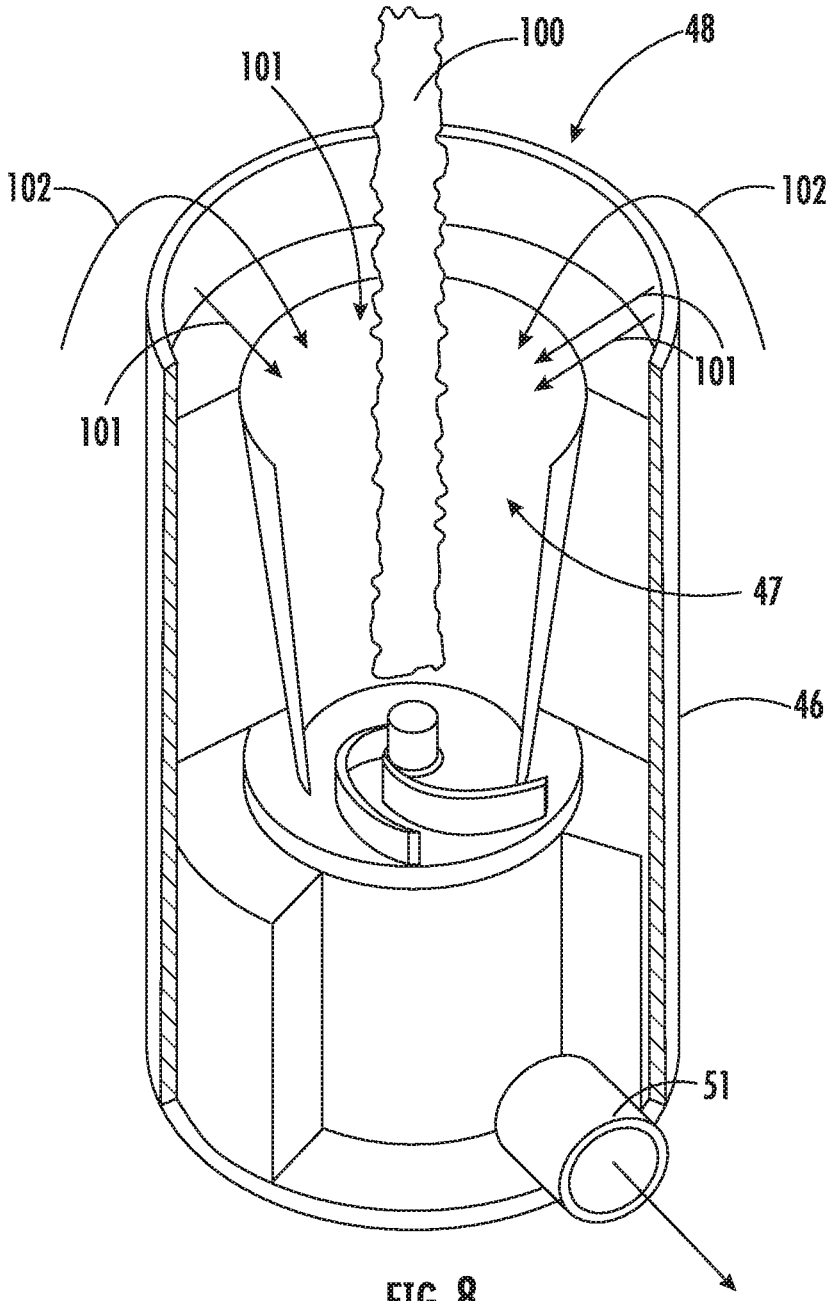
FIG. 8 is an schematic view of the wetting unit of FIG. 7.
Figure 9:
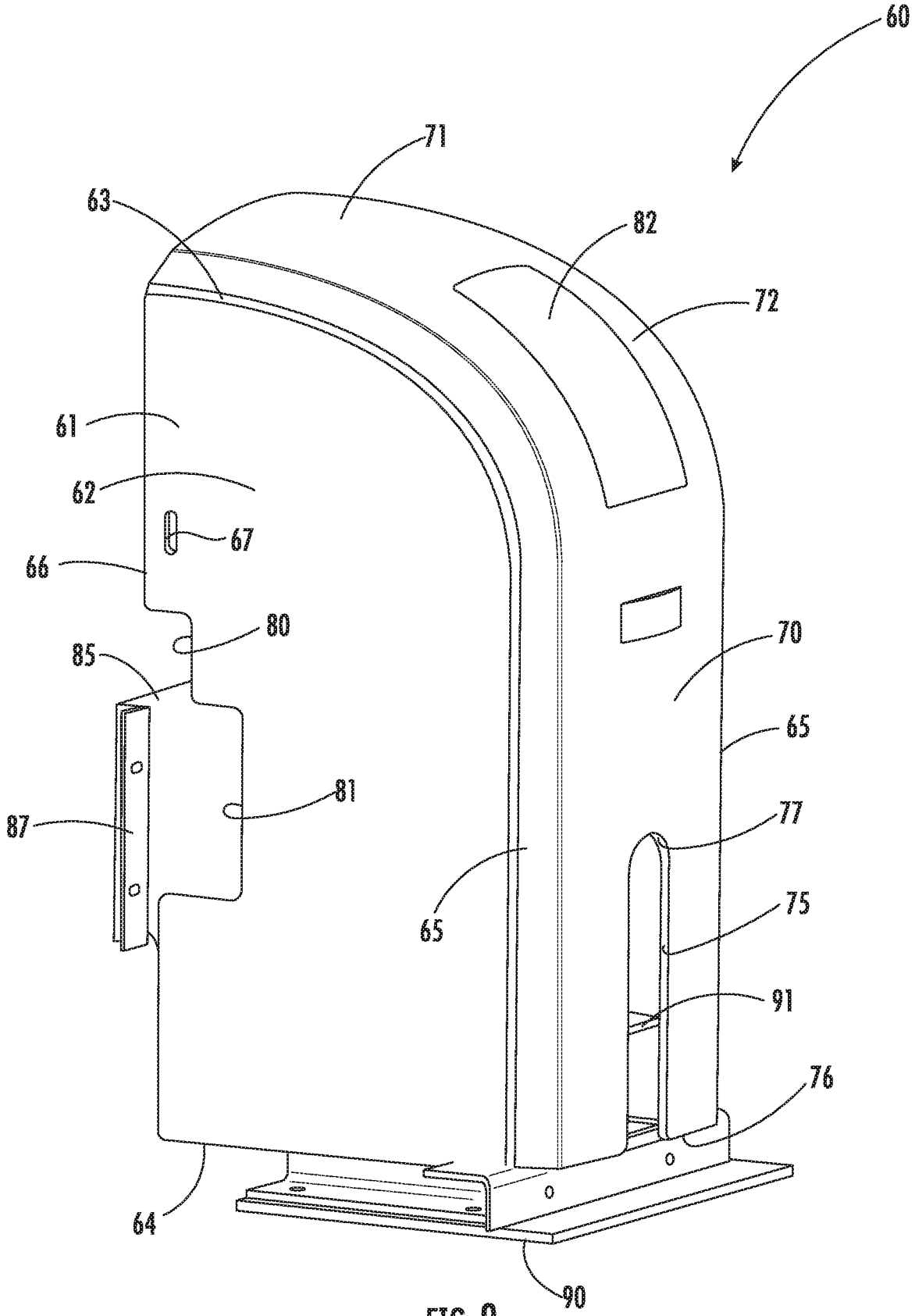
FIG. 9 is a perspective view of the shroud assembly of FIG. 2.
Figure 10:
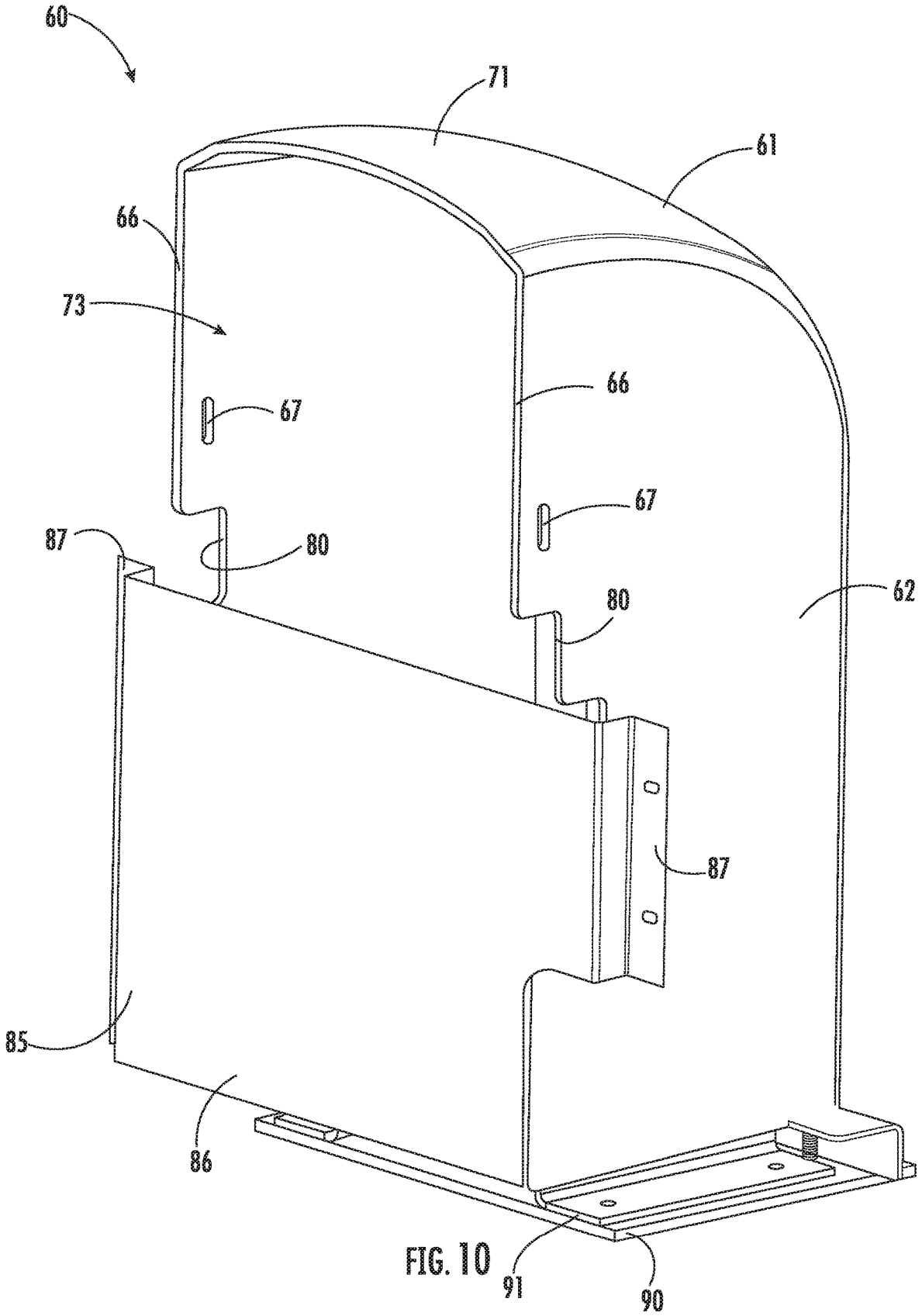
FIG. 10 is a perspective view similar to FIG. 9 but from a second perspective.
Figure 11:
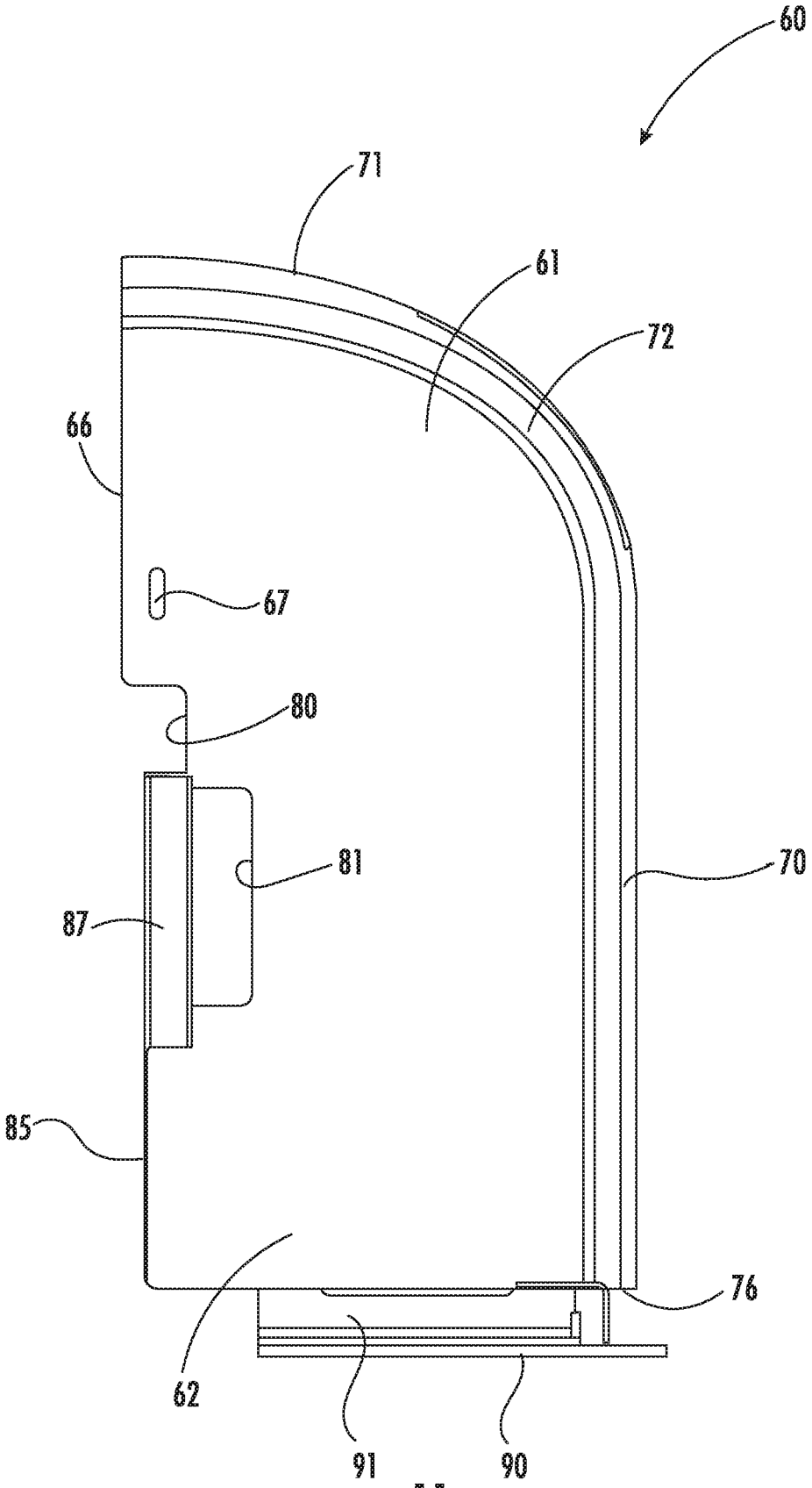
FIG. 11 is a side view of the shroud assembly of FIG. 9.
Figure 12:
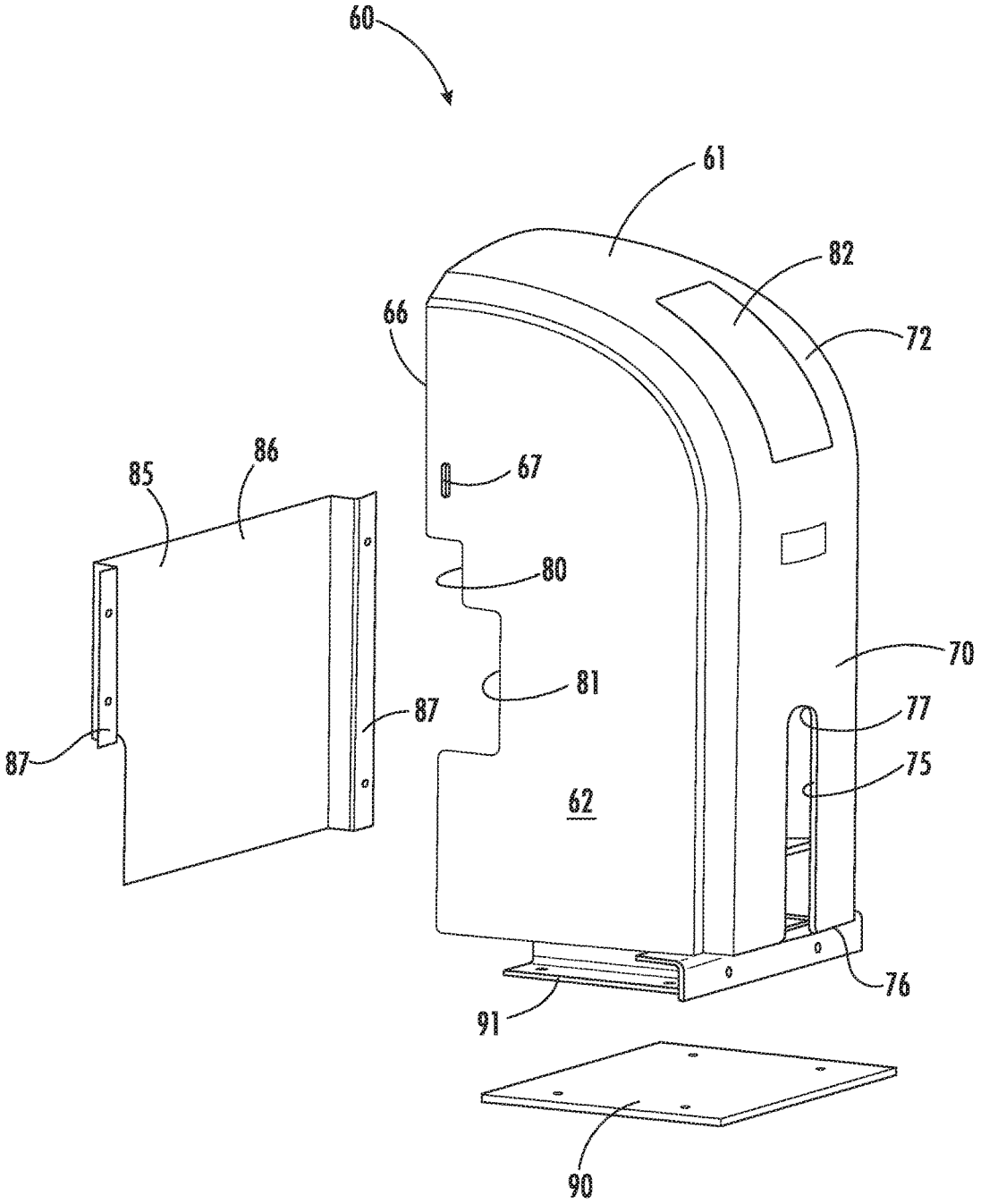
FIG. 12 is a partially exploded perspective view of the shroud assembly of FIG. 9.

The wetting unit 45 may be configured as a generally cylindrical eductor 46 with a cylindrical central cavity 47 (FIGS. 7-8) having an open upper end or inlet 48 through which powder material 100 may enter or be drawn into the eductor. Mixing liquid such as water is supplied at a plurality of ports (not shown) that are connected to the feed lines 43 of the liquid supply system 36. As configured, the ports are configured so that the liquid enters adjacent or near the top of the central cavity 47 as depicted by arrows 101 in FIG. 8 and travels around the cavity in a circular or rotating manner and then flows downward through the central cavity to outlet line 51 fluidly connected to the central cavity. If desired, structures or elements such as vanes may be provided within the central cavity 47 or another location at the eductor to create a circular or swirling flow of liquid within the central cavity to facilitate mixing of the liquid and powder material. The outlet line 51 is fluidly connected to the additional supply line 44 of the liquid supply system 36 through a T-connection 52 (FIG. 1). In operation, liquid flows through the additional supply line 44 at a sufficient rate to create an area of a reduced pressure or vacuum within the outlet line 51 and thus within the central cavity 47. The reduced pressure within the central cavity 47 draws in air as depicted by arrows 102 in FIG. 8 which also assists in drawing the powder material from the feed assembly 26 into the central cavity where it is mixed with the rotating flow of liquid supplied by the ports connected to the feed lines 43.

The mixture or solution of powder material and liquid within the eductor 46 flows and/or is drawn out of the central cavity 47 through the outlet line 51 as a result of the reduced pressure and mixes with the liquid flowing through the additional supply line 44 and flows into tank 53 through line or pipe 54 extending between the T-connection 52 and the tank.

The end or orifice 28 of the feed tube 27 of the feed assembly 26 is horizontally positioned relative to the central cavity 47 of the eductor 46 so that powder material fed from the feed tube falls as a result of gravity into the central cavity. In one embodiment, the orifice 28 is aligned with a central axis extending vertically through the central cavity 47. The feed tube 27 may be positioned vertically relative to the eductor 46 so that powder material exiting the feed tube disperses into a cone of a desired diameter as it reaches the open upper end 48 of the central cavity 47 to improve the wetting operation within the eductor.

In order to reduce the impact of airflow or air currents on the powder material falling from the feed tube 27 into the eductor 46, a shroud assembly 60 may be disposed about portions of the feed assembly 26 and the wetting unit 45. The operation of systems in which the diameter of the powder material may be as small as 200 μm or less may be especially susceptible to adverse effect caused by even relatively small airflow or air currents. Referring to FIGS. 9-13, as depicted, the shroud assembly 60 includes a primary shroud 61 and a secondary or rear shroud 85. In some embodiments, a lower plate or base 90 may also be provided. Still further, elements of the system 10 that cooperate with the primary shroud 61, the rear shroud 85, and/or the base 90 may also be considered portions of the shroud assembly 60. For example, as described below, the front face 22*f* of the housing 22 cooperates with the primary shroud to encircle or surround the end 28 of the feed tube 27 and the upper end 48 of the central cavity 47 of the eductor 46 and thus may be considered a portion of the shroud assembly 60 unless inconsistent with the context of this disclosure.

Figure 13:
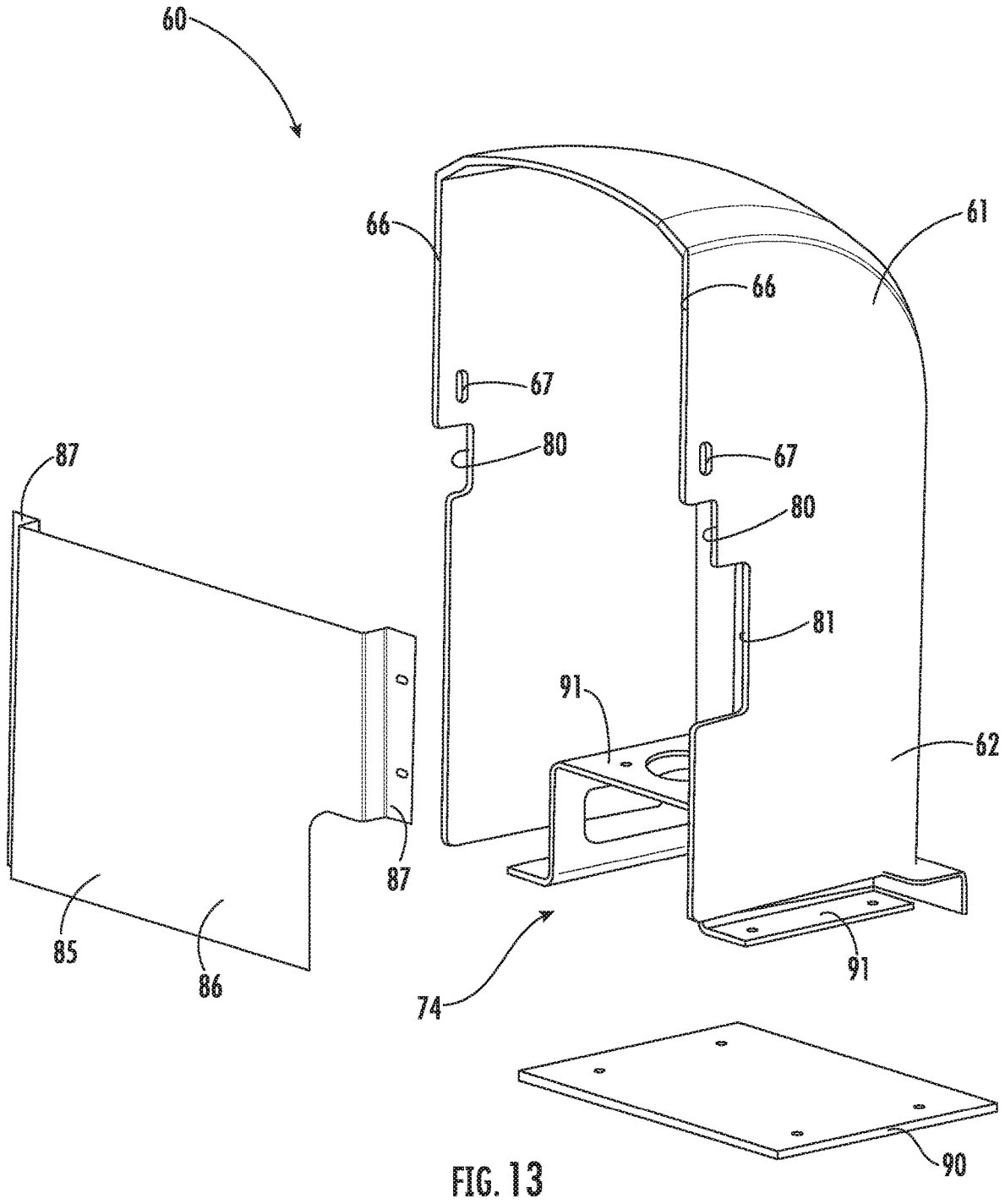
FIG. 13 is a partially exploded perspective view of the shroud assembly but taken from the perspective of FIG. 10.

The primary shroud 61 is generally elongated in a vertical direction and includes a pair of spaced apart sidewalls 62. The sidewalls 62 include a upper edge 63, a lower edge 64, opposite the upper edge, a front edge 65 and a rear edge 66 opposite the front edge. The primary shroud 61 further includes a front wall 70 extending between and interconnecting the sidewalls 62 along their front edges 65 and an upper wall 71 extending between and interconnecting the sidewalls along their upper edges 63. As depicted, a curved or arcuate section 72 extends between and interconnects the sidewalls 62 and interconnects the front wall 70 and the upper wall 71. In other embodiments, the front wall 70 and the upper wall 71 may be interconnected at a right angle or in other manners. The primary shroud 61 can include an open rear face 73 (FIG. 10) and an open lower face 74 (FIG. 13).

Each sidewall 62 can include a vertical slot 67 along the rear edge 66 to facilitate mounting of the primary shroud 61 to the housing 22 of the feed assembly 20. The housing 22 can include a pair of spaced apart flanges 29 (FIG. 3) extending from the front wall 28 of the housing and parallel to the feed tube 27. The flanges 29 can be spaced apart to align with inner surfaces of the sidewalls 62 adjacent the rear edges 66. Each flange 29 may have one half of a fastener assembly such as a threaded bore or a nut disposed thereon and aligned with one of the slots 67 upon positioning or mounting the primary shroud 61 adjacent the front wall 28 of housing 22. A second half of a fastener assembly such as a bolt 95 may extend through each slot 67 and into the first half of the fastener assembly to secure the primary shroud 61 to the housing 22.

An elongated vertical slot 75 extends upward from a lower edge 76 of the front wall 70 approximately halfway towards the curved section 72. The upper end 77 of the slot 75 may be curved or arcuate and aligned with the outlet line 51 to permit the outlet line to pass through the shroud assembly 60 upon mounting the primary shroud 61 to the housing 22. In an embodiment, the upper end 77 of the slot 75 may be configured to closely match the dimensions of the outlet line 51 to reduce air flow through the slot above the outlet line.

In addition, the sidewalls 62 may also include frame mounting openings 80 that match the configuration of the front horizontal member **33*f* (FIG. 3) of the frame assembly 32 to permit the primary shroud 61 to generally seal (i.e., reduce air flow) at the intersection of the front horizontal member and the primary shroud. If desired, sealing material may be provided between the front horizontal member 33*f* and the frame mounting openings 80 to improve the sealing between the primary cover and the frame assembly 32**.

A feed opening 81 along one of the sidewalls 62 below the frame mounting opening 80 may be provided to accommodate the manifold 42 and feed lines 43 that supply the eductor 46 with liquid. If desired, additional sealing may be provided. In one embodiment, a relatively large seal (not shown) may enclose the feed opening 81 and the feed lines 43 may extend through the seal. In another embodiment, the feed opening 81 may be replaced by a smaller individual feed opening (not shown) for each feed line 43. In still another embodiment, the opening between each individual feed line 43 and one of the individual openings may include an individual seal.

If desired, a sealing material such as foam may be applied along the rear edges 66 of the sidewalls 62 above the frame mounting openings 80 and along the rear edge 72 of the upper wall 71 to assist in sealing the primary shroud 61 to the housing 22. If desired, the curved section 72 interconnecting the front wall 70 and the upper wall 71 may include a transparent window 82 to permit visual inspection or observation of the supply of powder material and liquid into the wetting unit 45 and the mixing thereof.

The rear shroud 85 includes a generally planar body 86 and L-shaped mounting brackets 87 at each horizontal end. The body 86 extends across the open rear face 73 beginning below the frame mounting openings 80 and interact with the sidewalls 62 of the primary shroud to generally seal the lower portion of the rear face. The L-shaped mounting brackets 87 are configured so that one leg of each mounting bracket can be mounted to the front edge of one of the vertical legs 34 of the frame assembly 32 to secure the rear shroud 85 to the frame assembly and position the rear shroud relative to the primary shroud 61.

The lower face 74 of the primary shroud 61 is open to facilitate mounting the primary shroud. A flat plate or base 90 may be mounted to a bracket 91 within the primary shroud 61 and upon which the eductor 46 is mounted. The sidewalls 62, and front wall 70 of the primary shroud 61 and the rear shroud 85 may be dimensioned and/or configured so that the base 90 seals the shroud assembly 60 along the lower face 74 of the primary shroud 61.

Through the configuration of the shroud assembly 60, airflow or air currents adjacent the end 28 of the feed tube 27 and the upper end 48 of the central cavity 47 of the eductor 46 may be substantially reduced. To do so, in one embodiment, the shroud assembly 60 may be configured to cooperate with other components (e.g., front face **22*f* of housing 22) to substantially seal the area surrounding (i.e., at the same vertical height) and above the end 28 of the feed tube and the upper end 48 of the central cavity 47 of the eductor 46. In another embodiment, the shroud assembly 60 may be configured to also substantially seal an area that extends downward a predetermined distance from the upper end 48 of the central cavity 47 of the eductor 46**.

As used herein, the phrase "substantially seal" refers to sealing all or almost all of the openings through which air may travel that could affect the powder material falling from the end 28 of the feed tube 27. In other words, the shroud assembly 60 and cooperating components do not necessarily completely seal the area surrounding and above the end 28 of the feed tube 27 and the upper end 48 of the central cavity 47 of the eductor 46 but seal the area sufficiently to reduce or eliminate the impact of airflow or air currents adjacent the system 10 on the falling powder material. In each instance, while the shroud assembly 60 may completely seal the area at a specified height relative to the upper end 48 of the eductor 46, the shroud assembly does not completely seal the eductor 46 to permit air to flow into the eductor during the material feeding process. More specifically, the shroud assembly 60 and cooperating components may not completely seal the eductor 46 (absent another air source) without negatively affecting the supply of air to, and thus the functionality of, the eductor.

As an example, the interface between the front face **22*f* of housing 22 and the rear edges 66 of the primary shroud may not be completely sealed. Still further, the primary shroud 61 may also not be sealed along the vertical slots 67 in the sidewalls 62, the vertical slot 75 in the front wall 70, the frame mount openings 80 in the sidewalls, and the feed opening 81 along one of the sidewalls. It should be noted that the vertical slot 75, the frame mount openings 80, and the feed opening 81 are positioned below the upper end 48 of the central cavity 47 of the eductor 46 and thus will likely have a lesser effect on the falling powder material. Further, the openings along the rear edges 66 of the primary shroud and the slots 67** are spaced from the falling powder and having a sufficiently small opening in order not to significantly affect the falling powder.

In an embodiment, the substantially sealed area may extend downward 0-10% of the height of the eductor. In another embodiment, the substantially sealed area may extend downward 10-25% of the height of the eductor. In still another embodiment, the substantially sealed area may extend downward 25-50% of the height of the eductor. In a further embodiment, the substantially sealed area may extend downward 50-75% or more of the height of the eductor.

In some instances, the rear shroud 85 may be omitted shroud assembly 60. However, rear shroud 85 may be useful to reduce airflow or air currents from the booster pump 38. Similarly, in some instances, the base 90 may be omitted from the shroud assembly 60.

In operation, water or another liquid is supplied by the liquid supply system 36 through the supply line 37 and into the booster pump 38. Liquid then travels through the outlet pipe 40 to the T-connection 41 with a first portion of the liquid passing through the manifold 42 and the feed lines 43 to the eductor 46. The liquid passing through the feed lines 43 and into the eductor 46 create a circular flow or vortex within the central cavity 47 of the eductor. A second portion of the liquid exiting the booster pump 38 travels through the additional supply line 44 and creates a reduced pressure area or vacuum at the outlet line 51 of the eductor 46. Powder material is fed through the feed tube 27 by the feed assembly 26 and falls via gravity into the central cavity 47 of the eductor 46 where it mixes with the rotating liquid within the eductor. The powder material begins to mix within the eductor 46 and is then drawn out through the outlet pipe 51 where it mixes with the second portion of the liquid that exits from the booster pump 38. The mixture of powder material and liquid then travels through the pipe 54 to the tank 53.

The use of the shroud assembly 60 prevents or substantially reduces the impact of external airflow or air currents on the falling powder material as it enters the open upper end 48 of the central cavity 47 of the eductor 46. As a result, the powder material may spread in a generally uniform manner as it exits the end 28 of the feed tube 27 and enters the open upper end 48 in a generally uniform manner. The consistency of the spread of falling powder material results in consistent mixing of the powder material and the liquid within the central cavity 47 of the eductor 46 which improves the quality or consistency of the aqueous liquid that enters the tank 53.

Further, the reduction in airflow or air currents adjacent the feed tube 27 and the eductor 46 through the use of the shroud assembly 60 permits the use of all or essentially all of the powder material without the need to sift out the extremely fine particles (e.g., 200 μm or smaller). As a result, the shroud assembly 60 also improves the efficiency of the manufacturing process by permitting a greater utilization of the powder material.

Any ranges given either in absolute terms or in approximate terms are intended to encompass both, and any definitions used herein are intended to be clarifying and not limiting. Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all subranges (including all fractional and whole values) subsumed therein.

All references, including publications, patent applications, and patents, cited herein are hereby incorporated by reference to the same extent as if each reference were individually and specifically indicated to be incorporated by reference and were set forth in its entirety herein.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A material wetting system for wetting a powder material, the system comprising:

a liquid supply system including a supply line configured to provide a liquid;

a material mixing unit in fluid communication with the supply line, the material mixing unit including a central cavity having an open upper end configured to receive a supply of powder material, the supply line opening into the material mixing unit whereby the liquid from the supply line flows directly into the material mixing unit, the material mixing unit being operatively connected to a reduced pressure source to draw air into the central cavity;

a material supply system including an orifice and being configured to feed powder material through the orifice, the orifice being disposed above the central cavity of the material mixing unit; and a shroud assembly disposed about the open upper end of the central cavity of the material mixing unit and the orifice of the material supply system.

2. The material wetting system of claim 1, wherein the shroud assembly substantially seals an area surrounding the orifice of the material supply system and the open upper end of the central cavity of the material mixing unit.

3. The material wetting system of claim 2, wherein the shroud assembly also substantially seals an area extending downward a predetermined distance from the open upper end of the central cavity of the material mixing unit.

4. The material wetting system of claim 1, wherein the shroud assembly comprises a pair of spaced apart sidewalls, a front wall, and a top wall, the front wall and the top wall extending between the sidewalls.

5. The material wetting system of claim 4, wherein the shroud assembly comprises a rear shroud opposite the front wall and extending between the sidewalls.

6. The material wetting system of claim 5, wherein the liquid supply system comprises a booster pump and the rear shroud is disposed between the booster pump and the material mixing unit to block airflow from the booster pump.

7. The material wetting system of claim 4, wherein the shroud assembly further comprises a plate below the material mixing unit, the plate extending between the sidewalls.

8. The material wetting system of claim 1, wherein the material mixing unit comprises a central axis extending through the central cavity and the orifice is disposed along the central axis.

9. The material wetting system of claim 1, wherein the central cavity is in fluid communication with an outlet line from which a mixture of liquid and powder material exits the central cavity.

10. The material wetting system of claim 9, wherein the liquid supply system comprises a second supply line fluidly connected to the material mixing unit to define the reduced pressure source.

11. The material wetting system of claim 10, wherein the second supply line is fluidly connected to the outlet line to central cavity to define the reduced pressure source.

12. The material wetting system of claim 11, wherein the second supply line is fluidly connected to the outlet line to mix the mixture of liquid and powder material exiting the outlet line with liquid from the second supply line.

13. The material wetting system of claim 1, wherein the material mixing unit comprises an eductor.

14. A material wetting system for wetting a powder material, the system comprising:

a liquid supply system including a supply line configured to provide a liquid, the liquid supply system including a booster pump;

an eductor in fluid communication with the supply line, the eductor including a central cavity having a central axis and an open upper end configured to receive a supply of powder material, the eductor being configured to receive the liquid from the supply line, the eductor being operatively connected to a reduced pressure source to draw air into the central cavity;

a material supply system including an orifice and being configured to feed powder material through the orifice, the orifice being disposed along the central axis and above the central cavity of the eductor; and a shroud assembly disposed about the open upper end of the central cavity of the eductor and the orifice of the material supply system, the shroud assembly including a wall disposed between the booster pump and the educator to block airflow from the booster pump.

15. The material wetting system of claim 14, wherein the shroud assembly substantially seals an area surrounding the orifice of the material supply system and the open upper end of the central cavity of the eductor.

16. The material wetting system of claim 15, wherein the shroud assembly also substantially seals an area extending downward a predetermined distance from the open upper end of the central cavity of the eductor.

17. The material wetting system of claim 14, wherein the shroud assembly comprises a pair of spaced apart sidewalls, a front wall, and a top wall, the front wall and the top wall extending between the sidewalls.

18. The material wetting system of claim 17, wherein the shroud assembly comprises a rear shroud opposite the front wall and extending between the sidewalls.

19. The material wetting system of claim 18, wherein the rear shroud is disposed between the booster pump and the eductor to block airflow from the booster pump.

20. The material wetting system of claim 14, wherein the central cavity is in fluid communication with an outlet line from which a mixture of liquid and powder material exits the central cavity.

* * * * *